US005786314A

United States Patent [19]

Sadlowski

[11] Patent Number: 5,786,314

[45] **Date of Patent: *Jul. 28, 1998**

[54] CONTROL OF CALCIUM PRECIPITATION IN AUTOMATIC DISHWASHING

[75] Inventor: Eugene Steven Sadlowski, Cincinnati, Ohio

[73] Assignee: The Procter & Gamble Company, Cincinnati, Ohio

[ * ] Notice: The term of this patent shall not extend beyond the expiration date of Pat. No. 5,591,703.

[21] Appl. No.: 733,892

[22] Filed: Oct. 18, 1996

Related U.S. Application Data

[63] Continuation of Ser. No. 469,744, Jun. 6, 1995, abandoned, which is a continuation of Ser. No. 147,219, Nov. 3, 1993, abandoned.

[51] Int. Cl.[6] ..... C11D 3/37; C11D 3/10; C11D 7/12; C11D 7/60

[52] U.S. Cl. ..... 510/230; 510/225; 510/226; 510/228; 510/229; 510/476; 510/478; 510/509; 510/511

[58] Field of Search ..... 510/223, 225, 510/226, 228, 229, 230, 476, 533, 509, 511, 478

[56] References Cited

U.S. PATENT DOCUMENTS

| | | | |
|---|---|---|---|
| 3,941,710 | 3/1976 | Gilbert et al. | 252/99 |
| 4,233,172 | 11/1980 | McLaughlin et al. | 252/99 |
| 4,416,794 | 11/1983 | Barrat et al. | 252/174.15 |
| 4,530,766 | 7/1985 | Hann et al. | 210/701 |
| 4,597,886 | 7/1986 | Goedhart et al. | 252/95 |
| 4,620,936 | 11/1986 | Kielman et al. | 252/99 |
| 4,704,233 | 11/1987 | Hartman et al. | 252/527 |
| 4,818,427 | 4/1989 | Altenschoepfer et al. | 252/174.21 |
| 4,908,148 | 3/1990 | Caravajal et al. | 252/135 |
| 4,919,841 | 4/1990 | Kamel et al. | 252/186.26 |
| 4,931,203 | 6/1990 | Ahmed et al. | 252/99 |
| 4,988,363 | 1/1991 | Barnes | 8/111 |
| 5,084,535 | 1/1992 | Hennig et al. | 526/211 |
| 5,152,911 | 10/1992 | Savio et al. | 252/95 |
| 5,173,207 | 12/1992 | Drapier et al. | 252/99 |
| 5,200,236 | 4/1993 | Lang et al. | 427/213 |
| 5,230,822 | 7/1993 | Kamel et al. | 252/174.13 |
| 5,268,119 | 12/1993 | Simpson et al. | 252/95 |
| 5,591,703 | 1/1997 | Sadlowski | 510/220 |
| 5,597,789 | 1/1997 | Sadlowski | 510/230 |

FOREIGN PATENT DOCUMENTS

| | | | |
|---|---|---|---|
| 0 140 435 | 5/1985 | European Pat. Off. | C11D 3/12 |
| 0 364 067 | 4/1990 | European Pat. Off. | C11D 3/10 |
| 414197 | 3/1991 | European Pat. Off. . | |
| 0 523 681 | 7/1992 | European Pat. Off. . | |
| 0 504 091 A1 | 9/1992 | European Pat. Off. | C11D 3/00 |
| 0 527 625 A2 | 2/1993 | European Pat. Off. | C11D 3/43 |
| 0 530 635 | 3/1993 | European Pat. Off. | C11D 3/20 |
| 0 551 670 A1 | 7/1993 | European Pat. Off. | C11D 11/00 |
| 2102851 | 3/1972 | France . | |
| 3 023 828 | 2/1982 | Germany . | |
| 4110 10 | 10/1992 | Germany . | |
| 673033 | 1/1990 | Switzerland . | |
| 1 586 067 | 3/1981 | United Kingdom | C11D 1/66 |
| 2 058 823 | 4/1981 | United Kingdom | C11D 1/34 |
| 2 204 319 | 11/1988 | United Kingdom | C11D 10/04 |
| WO 92/17565 | 10/1992 | WIPO | C11D 17/06 |

OTHER PUBLICATIONS

U.S. application No. 08/469,740, E. S. Sadlowski, filed Jun. 6, 1995.

U.S. application No. 08/147,222, Jing-Feng You, filed Nov. 3, 1993.

U.S. application No. 08/147,224, E. S. Sadlowski, filed Nov. 3, 1993.

*Primary Examiner*—Ardith Hertzog

*Attorney, Agent, or Firm*—Brian M. Bolam; Kim William Zerby; Jacobus C. Rasser

[57] ABSTRACT

Automatic dishwashing detergent compositions comprising a weight to weight ratio of calcium complexing component to carbonate source of at least 0.9 and having a pH between about 7 and about 11 are disclosed. The compositions exhibit enhanced filming performance, particularly preferred compositions additionally contain polymer dispersant and silicate.

20 Claims, No Drawings

CONTROL OF CALCIUM PRECIPITATION IN AUTOMATIC DISHWASHING

This is a continuation of application Ser. No. 08/469,744, filed on Jun. 6, 1995 now abandoned, which is a continuation of application Ser. No. 08/147,219, filed Nov. 3, 1993, now abandoned.

TECHNICAL FIELD

The present invention is in the field of automatic dishwashing detergents. More specifically, the invention relates to automatic dishwashing detergents and to the use of such compositions in providing enhanced filming benefits. The automatic dishwashing compositions provide specific ratios of components wherein carbonate precipitation (deposition) is inhibited in the wash cycle.

BACKGROUND OF THE INVENTION

Granular automatic dishwashing detergents (hereinafter ADDs) used for washing tableware in the home or institutionally in machines especially designed for the purpose have long been known. Dishwashing in the seventies is reviewed by Mizuno in Vol. 5, Part III of the Surfactant Science Series, Ed. W. G. Cutler and R. C. Davis, Marcel Dekker, N.Y., 1973, incorporated by reference. The particular requirements of cleansing tableware and leaving it in a sanitary, essentially spotless, residue-free state has indeed resulted in so many particular ADD compositions that the body of art pertaining thereto is now recognized as quite distinct from other cleansing product arts.

In light of legislation and current environmental trends, modern ADD products are desirably substantially free of inorganic phosphate builder salts and/or are concentrated formulations (i.e. ½ cup vs. full cup). Unfortunately, non-phosphated ADD products in technical terms may sacrifice efficacy, especially owing to the deletion of phosphate and, in some instances, chlorine mainstay cleansing ingredients. Concentrated or compact compositions similarly exhibit formulation problems.

Users of ADDs have come to expect tableware will be rendered essentially spotless and film-free in addition to cleaning. In practice, this means avoiding film-forming components. The formulator must employ ingredients which are sufficiently soluble that residues or build-up do not occur in the automatic dishwashing appliance. Again, while some ingredients may be adequate on grounds of cleaning, spotting and filming, solubility considerations may diminish their usefulness. Solubility considerations are even more acute with the newer "high density", "low usage", "concentrated", ADD compositions whose overall solubility can be less than that of low-density granular products.

Generally, carbonate is added to an ADD composition as a builder, alkalinity source, bleaching source, etc. Although these ingredients contribute to the overall performance, carbonate precipitation ($CaCO_3$) often is formed on tableware and the dishwashing machine. Carbonate precipitation can also be caused by carbonate which comes in through the wash water. Dispersants (i.e. polyacrylates) are often used in ADDs to prevent deposition of the carbonate precipitation. It has been surprisingly found that carbonate deposition (precipitation) can also be inhibited by controlling the pH of the automatic dishwasher wash solution and/or by controlling the w/w ratio of carbonate complexing component to carbonate.

It has therefore been found that calcium carbonate precipitation can also be inhibited in carbonate containing compositions by formulating automatic dishwashing detergent compositions containing a w/w ratio of carbonate complexing component to carbonate of at least about 0.8.

Alternatively it has also been discovered that automatic dishwashing detergents can be provided which exhibit greatly reduced rates and extents of carbonate precipitation (i.e. reduced filming and machine deposits) by formulating ADDs having a particularly defined pH range such that composition when dissolved in an automatic dishwasher affords a pH less than 9.5, preferably in the range from about 5.0 to about 9.5 more preferably from about 6.0 to about 9.4, most preferably from about 7.0 to about 9.3. ADD embodiments including phosphate free compositions and enzyme-containing compositions are provided for powerful cleaning of wide-ranging soils while retaining the advantages of a generally mild and noncorrosive product matrix.

SUMMARY OF THE INVENTION

The present invention encompasses automatic dishwashing detergent compositions, especially granular or powder-form automatic dishwashing detergent compositions, comprising by weight (a) from about 1% to about 50%, preferably from about 10% to about 40%, most preferably from about 15% to about 30% of a carbonate source selected from the group consisting of salts of carbonate, bicarbonate, sesquicarbonate, percarbonate, and mixtures thereof; and (b) a w/w ratio of at least 0.8, more preferably at least 0.9, more preferably at least 1.0 of calcium complexing component/carbonate.

While carbonate components and suitable calcium complexing components are the essential ingredients to the present invention, there are also provided embodiments wherein additional components, are desirably present. Highly preferred embodiments of the invention are substantially free from phosphate salts and have low (e.g., <10% $SiO_2$) total silicate content, bleaching, enzymes and mixtures thereof. Additional components include but are not limited to suds suppressors, detergent surfactants, polymer dispersants and mixtures thereof.

The present invention also encompasses a method for cleaning soiled tableware comprising contacting said tableware with an aqueous medium having a pH range from about 5.0 to about 11.0, preferably from about 6.0 to about 10.5, more preferably from about 7.0 to about 10.0, most preferably from about 8.0 to about 9.5 and comprising at least about 2% of a pH adjusting agent; said aqueous medium being formed by dissolving an automatic dishwashing detergent containing the essential carbonate component and calcium complexing components in an automatic dishwashing machine.

DETAILED DESCRIPTION OF THE INVENTION

An automatic dishwashing detergent composition comprising by weight a) from about 1% to about 50% preferably from about 10% to about 35% of a carbonate source selected from the group consisting of carbonate, bicarbonate, percarbonate and mixtures thereof, and b) a w/w from of at least about 0.8 of calcium complexing component to carbonate.

A particularly preferred embodiment further comprises from about 2% to about 20% silicate, from about 5% to about 20% bleach and from about 0.5% to about 20% polymer dispersant.

The term "substantially free" herein refers to substances that are not intentionally added to the ADD but could be present as impurities in commercial grade raw materials or feedstocks. For example, the present invention encompasses substantially phosphate-free embodiments. Such embodiments generally comprise less than 0.5% of phosphate as $P_2O_5$.

The terms "wash solution" or "wash water" as defined herein mean a solution of the composition of the present invention dissolved under realistic use conditions of concentration and temperature.

Carbonate Source

The carbonate component may be added to the automatic dishwashing detergent compositions from a variety of sources, i.e. builders, pH adjusting components, and alkalinity sources (i.e., carbonate and bicarbonate) and peroxygen bleaches (i.e., percarbonate). These sources are discussed in further detail herein.

Without being bound by theory it is believed that the present invention controls the following set coupled equilibria:

(1) $Ca^{2+}+CO_3^{=}=CaCO_3$ (2) $Ca^{2+}+Citrate^{3-}=CaCit^{-}$ (3) $H^{+}+CO_3^{=}=HCO_3$ The rate of $CaCO_3$ of reaction (1) can be affected by the instantaneous availability of $Ca^{2+}$ or $CO_3^{=}$ according to reactions (2) and (3), respectively (citrate is only being used as an example of a calcium complexing component). In the present invention a complexing builder can compete with $CO_3^{=}$ for $Ca^{2+}$ and/or the $HCO_3^{-}/CO_3^{=}$ equilibrium can be displaced in the direction of $HCO_3^{-}$, the net effect is to reduce the rate of $CaCO_3$, precipitation.

Accordingly, $CaCO_3$ precipitation is reduced by formulating an automatic dishwashing product which provides a (1) wash water pH of 9.5 or less and/or (2) w/w ratio of calcium complexing component to carbonate of no less than 0.8, preferably no less than 0.9, more preferably no less than 1.0.

pH-Adjusting Components

The compositions herein comprise a pH-adjusting component selected from water-soluble alkaline inorganic salts and water-soluble organic or inorganic builders. It has been discovered that to secure the filming benefits of the invention, the carbonate component may be a pH-adjusting component. The ADD compositions of the present invention delivers a wash solution pH of from 7 to about 12, preferably from about 8 to about 11. The pH-adjusting component is selected so that when the ADD is dissolved in water at a concentration of 2000–4000 ppm, the pH remains in the range stated above.

The preferred nonphosphate pH-adjusting component of the invention is selected from the group consisting of (i) sodium carbonate or sesquicarbonate (ii) sodium silicate, preferably hydrous sodium silicate having $SiO_2$:$Na_2O$ ratio of 2:1;

(iii) sodium citrate (iv) citric acid (v) sodium bicarbonate (vi) sodium borate, preferably borax (vii) sodium hydroxide; and (viii) mixtures of (i)–(vii).

Illustrative of highly preferred pH-adjusting component systems are binary mixtures of granular sodium citrate or citric acid with sodium carbonate or bicarbonate, and three-component mixtures of granular sodium citrate trihydrate, citric acid and sodium bicarbonate or carbonate.

The amount of the pH adjusting component in the instant ADD compositions is generally from about 1% to about 99%, preferably from about 5% to about 50%, by weight of the composition. In a preferred embodiment, the pH-adjusting component is present in the ADD composition in an amount from about 5% to about 40%, preferably from about 10% to about 35%, by weight.

Particularly preferred ADD embodiments comprise, by weight of ADD, from about 5% to about 40%, preferably from about 10% to about 30%, most preferably from about 15% to about 20%, of sodium citrate or citric acid with from about 5% to about 30%, preferably from about 7% to 25%, most preferably from about 8% to about 20% sodium carbonate.

In general, pH values of the instant compositions can vary during the course of the wash. The best procedure for determining whether a given composition has the herein-indicated pH values is as follows: make an aqueous solution or dispersion of all the ingredients of the composition by mixing them in finely divided form with the required amount of water to have a 3000 ppm total concentration. Do not have any coatings on the particles capable of inhibiting dissolution. Then measure the pH using a conventional glass electrode at ambient temperature, within about 2 minutes of forming the solution or dispersion. To be clear, this procedure relates to pH measurement and is not intended to be construed as limiting of the ADD compositions in any way; for example, it is clearly envisaged that fully-formulated embodiments of the instant ADD compositions may comprise a variety of ingredients applied as coatings to other ingredients.

The essential pH-adjusting system can be complemented (for improved sequestration in hard water) by other optional detergency builder salts selected from nonphosphate and phosphate detergency builders known in the art. Nonphosphate builders include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S— form); nitrilotriacetic acid, tartrate monosuccinic acid, tartrate disuccinic acid, oxydisuccinic acid, carboxymethyloxysuccinic acid, mellitic acid, and sodium benzene polycarboxylate salts. Although the use of an optional detergency builder salt with strong metal-sequestering tendencies can be desirable for cleaning results, it is generally undesirable in that it may enhance corrosion of dishware.

Examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid and the sodium and potassium salts of ethane, 1,1,2-triphosphonic acid. Other phosphorus builder compounds are disclosed in U.S. Pat. Nos. 3,159, 581; 3,213,030; 3,422,021; 3,422,137; 3,400,176 and 3,400148, incorporated herein by reference.

Bleach Component

The ADD compositions of the present invention contain an amount of chlorine or oxygen bleach sufficient to provide from 0% to about 5%, preferably from about 0.1% to about 5.0%, most preferably from about 0.5% to about 3.0%, of available oxygen (as O) or available chlorine (as $Cl_2$) by weight of the ADD.

Available oxygen or available chlorine is the equivalent bleaching oxygen content thereof expressed as %O by weight or the bleaching chlorine content expressed as % equivalent $Cl_2$. For example, commercially available sodium perborate monohydrate typically has an available oxygen content for bleaching purposes of about 15% (theory predicts a maximum of about 16%). Conventional analytical methods for determining available chlorine comprise addition of an excess of an iodide salt and titration of the liberated free iodide with a reducing agent such as thiosulfate. Methods for determining available oxygen of a formula after manufacture share similar chemical principles but depend on whether the oxygen bleach incorporated therein is a simple hydrogen peroxide source such as sodium perborate or percarbonate, is an activated type (e.g., perborate with tetra-acetyl ethylenediamine) or comprises a preformed peracid such as monoperphthalic acid. Analysis of peroxygen compounds is well-known in the art: see, for example, the publications of Swern, such as "Organic Peroxides", Vol. I, D. H. Swern, Editor; Wiley, N.Y., 1970, LC #72-84965, incorporated by reference. See for example the calculation of "percent active oxygen" at page 499. This term is equivalent to the terms "available oxygen" or "percent available oxygen" as used herein.

Examples of suitable oxygen-type bleaches are described in U.S. Pat. No. 4,412,934 (Chung et al), issued Nov. 1, 1983, and peroxyacid bleaches described in European Patent Application 033,2259, Sagel et al, published Sep. 13, 1989, both incorporated herein by reference, can be used as a partial or complete replacement of chlorine bleach. Oxygen bleaches are particularly preferred when it is desirable to reduce the total chlorine content or use enzyme in the instant compositions.

Preferred oxygen bleaches herein are sodium perborate monohydrate and sodium percarbonate, particularly preferred is sodium percarbonate which is a carbonate source as discussed herein above. The percarbonate is therefore considered in determining the w/w ratio of calcium complexing component to carbonate. Optionally the percarbonate is combined with conventional activators. For excellent results at lower pH's (e.g., 9 and below), it is desirable to formulate perborate or percarbonate with benzoyloxybenzenesulfonate (BOBS) activator (or equivalent operating well at low pH). Other activators include tetraacetyletheylene diamine (TAED), benzoylcaprolactam, 4-nitrobenzoylcaprolactam, 3-chlorobenzolycaprolactam, nonanoyloxybenzenesulphate (NOBS) perhydrolizable esters and mixtures thereof.

Use of a preformed peracid, such as m-chloroperbenzoic acid or potassium monopersulfate, is also acceptable. In this instance there is evidently no need to react hydrogen peroxide (or HOO—) with activator, hence optimum bleaching can be secured without first having to drive peracid formation.

Preferred inorganic bleach ingredients such as chlorinated trisodium phosphate can be utilized, but organic chlorine bleaches such as the chlorocyanurates are preferred. Water-soluble dichlorocyanurates such as sodium or potassium dichloroiocoyanurate dihydrate are particularly preferred.

When such active bleaching compounds are used in the presence of detersive enzymes, it is may be preferred to delay the onset of bleaching action, e.g., by coating the bleach with a slow-dissolving nonionic surfactant, so that the enzyme has adequate opportunity to carry out its cleaning function before the bleach is delivered to the wash. Coatings may include LFNI coating agents, and may in general be applied to any of (i) activator (ii) peracid and (iii) pH-adjusting agents.

Silicates

The compositions of the type described herein optionally, but preferably comprise alkali metal silicates. The alkali metal silicates hereinafter described provide protection against corrosion of metals and against attack on dishware, including fine china and glassware benefits. However, it has been discovered that best results (i.e. enhanced galls care benefits) can be achieved when the sodium silicate levels are kept at low levels at low pH (i.e. pH from about 7 to about 9.5).

When silicates are present, the $SiO_2$ level should be from about 1% to about 25%, preferably from about 2% to about 20%, more preferably from about 6% to about 15%, based on the weight of the ADD. The ratio of $SiO_2$ to the alkali metal oxide (M2O, where M=alkali metal) is typically from about 1 to about 3.2, preferably from about 1.6 to about 3, more preferably from about 2 to about 2.4. Preferably, the alkali metal silicate is hydrous, having from about 15% to about 25% water, more preferably, from about 17% to about 20%.

The highly alkaline metasilicates can in general be employed, although the less alkaline hydrous alkali metal silicates having a $SiO_2$:$M_2O$ ratio of from about 2.0 to about 2.4 are, as noted, greatly preferred. Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns. Compositions of the present invention having a pH of about 9 or less preferably will be substantially free of alkali metal silicate.

Low-Foaming Nonionic Surfactant

ADD compositions of the present invention can comprise low foaming nonionic surfactants (LFNIs). LFNI can be present in amounts from 0 to about 10% by weight, preferably from about 0.1% to about 10%. LFNIs are surfactants other than amine oxides, and are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.6° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB)412. Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available SLF18 from Olin Corp. and any biodegradable LFNI having the melting point properties discussed hereinabove.

Anionic Co-surfactant

The automatic dishwashing detergent compositions herein can additionally contain an anionic co-surfactant substantially free of amine oxide and LFNI. When present, the anionic co-surfactant is typically in an amount from 0 to about 10%, preferably from about 0.1% to about 8%, more preferably from about 0.5% to about 5%, by weight of the ADD composition.

Suitable anionic co-surfactants include branched or linear alkyl sulfates and sulfonates. These may contain from about 8 to about 20 carbon atoms. Other anionic cosurfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic co-surfactants include sulfobetaines, betaines, alkyl(polyethoxy)sulfates (AES) and alkyl (polyethoxy)carboxylates which are usually high sudsing. Optional anionic co-surfactants are further illustrated in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

Preferred alkyl(polyethoxy)sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred. Where the compositions of the invention are formulated to have a pH of between 6 to 9.5, preferably between 7.5 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl (polyethoxy)sulfate surfactants for inclusion in the present invention are the $C_{12}$–$C_{15}$ alkyl ethoxysulfate surfactants with an average degree of ethoxylation of from 1 to 5, preferably 2 to 4, most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Alkyl(polyethoxy)carboxylates suitable for use herein include those with the formula $RO(CH_2CH_20)x\ CH_2C00—M^+$ wherein R is a $C_6$ to C18 alkyl group, x ranges from 0 to 10, and the ethoxylate distribution is such that, on a weight basis, the amount of material where x is 0 is less than about 20%, preferably less than about 15%, most preferably less than about 10%, and the amount of material where x is greater than 7, is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation, preferably chosen from alkali metal, alkaline earth metal, ammonium, mono-, di-, and tri-ethanol-ammonium, most preferably from sodium, potassium, ammonium and mixtures thereof with magnesium ions. The preferred alkyl(polyethoxy) carboxylates are those where R is a $C_{12}$ to C18 alkyl group.

Highly preferred anionic cosurfactants herein are sodium or potassium salt-forms for which the corresponding calcium salt form has a low Krafft temperature, e.g., 30° C. or below, or, even better, 20° C. or lower. Without being limited by theory, it is believed that film on hard surfaces can be minimized by using the compositions of the present invention containing calcium salts of anionic cosurfacants with low Krafft temperatures and having a pH between about 8 and about 11. Examples of such highly preferred anionic cosurfactants are the alkyl(polyethoxy)sulfates.

The preferred anionic co-surfactants of the invention in combination with the other components of the composition provide excellent cleaning and outstanding performance from the standpoints of residual spotting and filming. However, many of these co-surfactants may also be high sudsing thereby requiring the addition of LFNI, LFNI in combination with alternate suds suppressors as further disclosed hereinafter, or alternate suds suppressors without conventional LFNI components.

Amine Oxide

The ADD compositions of the present invention can optionally comprise amine oxide in accordance with the general formula I:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected represents propyleneoxy, and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18 from Ethyl Corp.

Preferred embodiments include hexadecyldimethylamine oxide dihydrate, octadecyldimethylamine oxide dihydrate and hexadecyltris(ethyleneoxy)dimethylamine oxide.

Whereas in certain of the preferred embodiments R'=CH3, there is some latitude with respect to having R' slightly larger than H. Specifically, the invention further encompasses embodiments wherein $R'=CH_2OH$, such as hexadecylbis(2-hydroxyethyl)amine oxide, tallowbis(2-hydroxyethyl)amine oxide, stearylbis(2-hydroxyethyl) amine oxide and oleylbis(2- hydroxyethyl)amine oxide.

As noted, certain preferred embodiments of the instant ADD compositions comprise amine oxide dihydrates. Conventional processes can be used to control the water content and crystallize the amine oxide in solid dihydrate form. A new process comprises (a) conventionally making amine oxide as an aqueous solution or aqueous/organic solvent solution by reacting appropriate parent amine and aqueous hydrogen peroxide (for example, 50% $H_2O_2$); (b) drying the product to secure substantially anhydrous amine oxide (with or without an organic solvent being present to keep the viscosity low); (c) adding two mole equivalents of water per mole of amine oxide; and (d) recrystallizing the wet amine oxide from a suitable solvent, such as ethyl acetate.

In formulating the instant ADD compositions, the amine oxide may be added to an ADD composition as a powder. This is especially appropriate in the case of the amine oxide dihydrates, since these are nonhygroscopic solids. When it is desired to use the anhydrous form of the amine oxides, it is preferable to protect the amine oxide from moisture. It is contemplated to achieve this by conventional means, such as by applying a relatively nonhygroscopic coating, e.g., an anhydrous coating polymer, to amine oxide particles. Alternately, and more preferably, the anhydrous amine oxide should be melted with a conventional low-melting, low-foaming waxy nonionic surfactant which is other than an amine oxide material. Such surfactants are commonly used as "sheeting agents" in granular automatic dishwashing compositions and are illustrated more fully hereinafter (see description hereinbelow of low foaming nonionic surfactant or LFNI). A desirable process comprises heating the LFNI to just above its melting-point, then adding the amine oxide steadily to the heated LFNI, optionally (but preferably) stirring to achieve a homogeneous mixture; then, optionally (but preferably) chilling the mixture. When the LFNI has a lower melting point than the amine oxide, the amine oxide need not be completely melted at any stage. The above process illustrates a manner in which the time and extent of exposure of amine oxide to heat are minimized. Once co-melted into a suitable LFNI, the combined LFNI/amine oxide may be applied to an inorganic support, e.g., a pH-adjusting component described hereinafter). One suitable approach is to form an agglomerate comprising amine oxide, LFNI and water-soluble alkaline inorganic salt or water-soluble organic or inorganic builder. In another embodiment, the amine oxide in anhydrous form is melted with a solid-form alcohol or, preferably, an ethoxylated alcohol: this may be appropriate if more cleaning action is required and less sheeting action is desired (e.g., in geographies wherein rinse-aid use is common).

Preferred amine oxides herein are substantially free of amine and/or nitrosamine ("impurity"). Preferably, the amine oxide comprises less than about 2% free amine, more preferably about 1% or lower; and less than about 500 parts per billion, more preferably less than about 50 parts per billion by weight nitrosamine.

The present invention can contain from 0% to about 10%, preferably from about 1% to about 7%, more preferably from about 1.5% to about 1.5% of the long chain amine oxide; levels are generally expressed on an anhydrous basis unless otherwise specifically indicated.

Long-Chain Amine Oxide Solubilizing Aids

Although short-chain amine oxides do not provide the cleaning effect of the long-chain amine oxide component discussed above, short-chain amine oxides, such as octyldimethylamine oxide, decyldimethylamine oxide, dodecylamine oxide and tetradecylamine oxide may be added as solubilizing aids to the long-chain amine oxide. This is especially preferred if the composition is for use in cold-fill automatic dishwashing appliances. When present, a short-chain amine oxide solubilizer is preferably at not more than 1/10 of the total mass of the cleaning amine oxide component. Thus, levels of short-chain amine oxide are typically in the range from about 0 to about 2.0%, preferably about 0.1% to about 1% of the ADD composition. Moreover, it has been discovered that a short-chain amine oxide, if used, is preferably uniformly dispersed within the long-chain amine oxide rather than being added to the ADD in a separate particle.

When the granular automatic dishwashing compositions are destined for use in hot-fill automatic dishwashing appliances, e.g., those commonly available in the United States, the essential long-chain amine oxide preferably comprises $R^1=C_{18}$ and is preferred over $R^1=C_{16}$ on grounds of mass efficiency; in this circumstance the use of short-chain amine oxide solubilizers is typically avoided.

Non-amine oxide solubilizing aids can be substituted, for example, solid-form alcohols or alcohol ethoxylates (the same as may be independently used for sheeting action or protection of the long-chain amine oxide from water discussed hereinabove) can be used for this purpose.

Silicone and Phosphate Ester Suds Suppressors

The ADDs of the invention can optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of component (f).

Phosphate esters have also been asserted to provide some protection of silver and silver-plated utensil surfaces, however, the instant compositions can have excellent silvercare without a phosphate ester component. Without being limited by theory, it is believed that lower pH formulations, e.g., those having pH of 9.5 and below, plus the presence of the essential amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Detersive Enzymes (including enzyme adjuncts)

The compositions of this invention may optionally, but preferably, contain from 0 to about 8%, preferably from about 0.001% to about 5%, more preferably from about 0.003% to about 4%, most preferably from about 0.005% to about 3%, by weight, of active detersive enzyme. The knowledgeable formulator will appreciate that different enzymes should be selected depending on the pH range of the ADD composition. Thus, Savinase® may be preferred in the instant compositions when formulated to deliver wash pH of 10, whereas Alcalase® may be preferred when the ADDs deliver wash pH of, say, 8 to 9. Moreover, the formulator will generally select enzyme variants with enhanced bleach compatibility when formulating oxygen bleaches containing compositions of the present invention.

In general, the preferred detersive enzyme herein is selected from the group consisting of proteases, amylases, lipases and mixtures thereof. Most preferred are proteases or amylases or mixtures thereof.

The proteolytic enzyme can be of animal, vegetable or microorganism (preferred) origin. More preferred is serine proteolytic enzyme of bacterial origin. Purified or nonpurified forms of enzyme may be used. Proteolytic enzymes produced by chemically or genetically modified mutants are included by definition, as are close structural enzyme variants. Particularly preferred by way of proteolytic enzyme is bacterial serine proteolytic enzyme obtained from Bacillus, *Bacillus subtilis* and/or *Bacillus licheniformis*. Suitable commercial proteolytic enzymes include Alcalase®, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Also preferred is what is called herein "Protease C", which is a triple variant of an alkaline serine protease from Bacillus in which tryrosine replaced valine at position 104, serine replaced asparagine at position 123, and alanine replaced threonine at position 274. Protease C is described in EP 90915958.A, corresponding to WO 91/06637, published May 16, 1991, which is incorporated herein by reference. Bacterial serine protease enzymes obtained from *Bacillus subtilis* and/or *Bacillus licheniformis* are preferred. Another preferred protease is herein referred to as "Protease D", a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue positions equivalent to those selected from the group consisting of +99, +101, +103, +107, and +123 in *Bacillus amyloliquiefaciens subtilisin* as described in the copending application of A. Baeck, C. K. Ghosh, P. P Greycar, R. R. Bott and L. J. Wilson, entitled "Protease-containing cleaning Compositions" and having U.S. Pat. Ser. No. 08/136,797 (P&G Case 5040). This application is incorporated herein by reference. Some preferred proteolytic enzymes, especially in the more alkaline ADDs herein, e.g., those delivering wash pH in the range from about 9 to about 10.5, are selected from the group consisting of Savinase®, Esperase®, Maxacal®, Purafect®, BPN', Protease A, Protease B, Protease D and mixtures thereof. Savinase® and Protease /b are most preferred.

Preferred lipase-containing compositions comprise from about 0.001 to about 0.01% lipase, from about 2% to about 5% amine oxide and from about 1% to about 3% low foaming nonionic surfactant.

Suitable lipases for use herein include those of bacterial, animal, and fungal origin, including those from chemically or genetically modified mutants. Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced from the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum* var.lipolyticum NRRlb 3673, and further *Chromobacter viscosum* lipases, and lipases ex *Pseudomonas gladioli*. A preferred lipase is derived from *Pseudomonas pseudoalcaligenes*, which is described in Granted European Patent, EP-B-0218272. Other lipases of interest are Amano AKG and Bacillis Sp lipase (e.g. Solvay enzymes). Additional lipases which are of interest where they are compatible with the composition are those described in EP A 0 339 681, published Nov. 28, 1990, EP A 0 385 401, published Sep. 5, 1990, EO A 0 218 272, published Apr. 15, 1987, and PCT/DK 88/00177, published May 18, 1989, all is incorporated herein by reference.

Suitable fungal lipases include those produced by *Humicola lanuginosa* and *Thermomyces lanuginosus*. Most preferred is lipase obtained by cloning the gene from *Humicola lanuginosa* and expressing the gene in *Aspergillus oryzae* as described in European Patent Application 0 258 068, incorporated herein by reference, commercially available under the trade name LipolaseR from Novo-Nordisk.

Any amylase suitable for use in a dishwashing detergent composition can be used in these compositions. Amylases include for example, a-amylases obtained from a special strain of *B. licheniforms, described* in more detail in British Patent Specification No. 1,296,839. Amylolytic enzymes include, for example, Rapidase™, Maxamyl™, Termamyl™ and BAN™. In a preferred embodiment, from about 0.001% to about 5%, preferably 0.005% to about 3%, by weight of active amylase can be used. Preferably from about 0.005% to about 3% by weight of active protease can be used. Preferably the amylase is Maxamyl™ and/or Termamyl™ and the protease is Savinase® and/or protease B. As in the case of proteases, the formulator will use ordinary skill in selecting amylases or lipases which exhibit good activity within the pH range of the ADD composition.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in the solid-form ADD composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Dispersant Polymer

Preferred compositions herein may additionally contain a dispersant polymer. When present, a dispersant polymer in the instant ADD compositions is typically in the range from 0 to about 25%, preferably from about 0.5% to about 20%, more preferably from about 1% to about 7% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, especially if the ADD is for use in North American automatic dishwashing appliances, is from about 1000 to about 5,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)]— wherein the incomplete valencies inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Agglomerated forms of the present invention may employ aqueous solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982, incorporated herein by reference.

Other, dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula $HO(CH_2CH_2O)_m(CH_2CH(CH_3)O)_n(CH(CH_3)CH_2O)OH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers, are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred cellulose-derived dispersant polymers are the carboxymethyl celluloses.

Yet another group of acceptable dispersant are the organic dispersant polymers such as polyaspartate.

Other Optional Adjuncts

Depending on whether a greater or lesser degree of compactness is required, filler materials can also be present in the instant ADDs. These include sucrose, sucrose esters, sodium chloride, sodium sulfate, potassium chloride, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates in magnesium-salt form. Note that preferences, in terms of purity sufficient to avoid decomposing bleach, applies also to component (b) ingredients.

Hydrotrope materials such as sodium benzene sulfonate, sodium toluene sulfonate, sodium cumene sulfonate, etc., can be present in minor amounts.

Bleach-stable perfumes (stable as to odor); and bleach-stable dyes (such as those disclosed in U.S. Pat. No. 4,714,562, Roselle et al, issued Dec. 22, 1987); can also be added to the present compositions in appropriate amounts. Other common detergent ingredients are not excluded.

Since certain ADD compositions herein can contain water-sensitive ingredients, e.g., in embodiments comprising anhydrous amine oxides or anhydrous citric acid, it is desirable to keep the free moisture content of the ADDs at a minimum, e.g., 7% or less, preferably 4% or less of the ADD; and to provide packaging which is substantially impermeable to water and carbon dioxide. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials which can readily be used to form suitable coated particles of any such otherwise incompatible components.

Method for Cleaning

The present invention also encompasses a method for cleaning soiled tableware comprising contacting said tableware with an aqueous medium having range pH in a wash solution from about 7 to about 12, more preferably from about 8 to about 11, and comprising at least about 1% of a carbonate source, such that a w/w ratio of calcium complexing component to carbonate is at least about 0.8; said aqueous medium being formed by dissolving a solid-form automatic dishwashing detergent containing in an automatic dishwashing machine.

The following examples illustrate the compositions of the present invention. All parts, percentages and ratios used herein are expressed as percent weight unless otherwise specified.

EXAMPLE I

Solutions containing 516 mg/l hydrated 2.0 ratio silicate (Britesil H20), sodium carbonate and sodium citrate are listed below. Calcium precipitation of these solutions are measured using the following method. The solutions are placed in a sample compartment of a Herwlett-Packared 8451A spectrophotometer, thermostatted to 55° C., and a reference spectrum is recorded along with the initial pH. At time t=0, an aliquot of a mixed solution of $CaCl_2$ and $MgCl_2$ is rapidly injected into the sample solution under mixing such that the final water hardness obtained in the sample is 15 grains/gallon and the molar ratio of $Ca^{2+}/Mg^{2+}$ was 3:1. Precipitation is monitored as a function of time by recording the turbidity at multiple wavelengths versus the reference. The absorbance values recorded at 300 nm for various time points after mixing are reported below.

TABLE 1

| sodium carbonate (mg/l) | sodium citrate (mg/l) | pH | absorbance at 300 nm 1.00 min. | 2.00 min | 15.00 min |
|---|---|---|---|---|---|
| 268.00 | 0.00 | 10.46 | 0.16 | 0.23 | 0.28 |
| 268.00 | 402.00 | 10.27 | 0.00 | 0.00 | −0.01 |
| 268.00 | 805.00 | 10.21 | −0.01 | −0.01 | −0.02 |
| 268.00 | 1,207.00 | 10.16 | 0.01 | 0.00 | 0.00 |
| 536.00 | 0.00 | 10.36 | 0.22 | 0.25 | 0.28 |
| 536.00 | 402.00 | 10.33 | −0.01 | 0.01 | 0.14 |
| 536.00 | 805.00 | 10.41 | −0.01 | 0.00 | −0.02 |
| 536.00 | 1,207.00 | 10.34 | −0.01 | 0.01 | −0.01 |
| 805.00 | 0.00 | 10.51 | 0.21 | 0.24 | 0.25 |
| 805.00 | 402.00 | 10.49 | 0.15 | 0.19 | 0.21 |
| 805.00 | 805.00 | 10.43 | −0.01 | −0.01 | 0.04 |
| 805.00 | 1,207.00 | 10.42 | 0.01 | 0.00 | 0.00 |

The data shows the extent of precipitation at 15 minutes is substantially reduced as the ratio of sodium citrate to sodium carbonate approaches 1.0.

EXAMPLE II

Automatic dishwashing detergent compositions are as follows:

TABLE 2

| Ingredient | % by weight of active material A | B | C | D |
|---|---|---|---|---|
| sodium citrate (active basis) | 10.00 | 20.00 | 10.00 | 20.00 |
| sodium carbonate | 20.00 | 20.00 | 30.00 | 24.40 |
| hydrated 2.0 ratio sodium silicate | 23.08 | 23.08 | 23.08 | 23.08 |
| Acusol 480N (active basis) | 6.00 | 6.00 | 9.00 | 7.90 |
| nonionic surfactant | 3.50 | 3.50 | 3.50 | 3.50 |
| Savinase 6.0T | 2.00 | 2.00 | 2.00 | 2.00 |
| Termamyl 60T | 1.10 | 1.10 | 1.10 | 1.10 |
| sodium perborate monohydrate | 9.87 | 9.87 | 9.87 | 9.87 |
| sodium sulfate and water | | balance | | |

Spotting and filming performance is evaluated. Glass tumblers (6 per machine) are washed for 7 cycles in General Electric automatic dishwashers. Product usages are 50% of the automatic dishwasher's prewash and mainwash dispenser cup volumes. 36 g of a test soil containing fat and protein are added to each machine at the beginning of the second through seventh cycles. Water hardness is 16–19 grains per gall with a 3:1 calcium/magnesium molar ratio and the was temperature is 130° F. Each test is repeated four times. Glasses are graded separately for both spotting and filming performance against photographic standards (scale= 4–9 with 4 the worst and 9 the best). Results are as follows.

TABLE 3

| | Test 1 | | Test 2 | |
|---|---|---|---|---|
| | Spotting | Filming | Spotting | Filming |
| A | 7.48 | 6.13 | 8.04 | 6.04 |
| B | 7.58 | 6.42 | | |
| C | 7.69 | 6.10 | | |
| D | | | 7.71 | 6.04 |
| LSD (.95) | 0.23 | 0.13 | 0.25 | 0.20 |

Test 1 shows that Composition B (sodium citrate/sodium carbonate ratio=1.0) has significantly better hard water filming performance than either Composition A (citrate/carbonate ratio=0.5), or Composition C (citrate/carbonate ratio=0.3). Test 2 shows Composition D (citrate/carbonate ratio=0.8) does not perform any better than Composition A (citrate/carbonate ratio=0.5) despite having a higher level of polyacrylate than Composition A.

EXAMPLE III

A granular automatic dishwashing detergent of the present invention is as follows:

TABLE 4

| Ingredients | % by weight of active material |
|---|---|
| Sodium Citrate | 4.00 |
| Coated citric acid[1] | 15.00 |
| Acusol 480N[2] | 6.00 |
| Sodium carbonate | 9.00 |
| Britesil (as $SiO_2$) H2O | 8.50 |
| C12–13 ethoxy$_{(3)}$sulfate | 3.00 |
| Termamyl 60T | 1.50 |
| Protease D (4.6% prill) | 1.60 |
| Percarbonate (Interox) (as AvO) | 1.50 |
| Tetraacetylethylene diamine (or Benzoyl caprolactam) | 3.80 |
| Diethylene triamine penta methylene phosphonic acid | 2.00 |
| pH | 9.00 |
| Sulfate, water, etc. | balance |

[1]Citric acid coated with 3.5% paraffin wax/petrolatum/$C_{16}H_{33}(OC_2H_4)_{2.0}OH$ ratio of 96.5:2.5:1.
[2]Dispersant from Rohm and Haas

EXAMPLE IV

Granular automatic dishwashing detergents of the present invention are as follows:

TABLE 5

| Ingredients | % by weight of active material |
|---|---|
| Citric acid | 18.60 |
| Acusol 480N[1] | 6.00 |
| Sodium carbonate | 4.50 |
| Britesil (as $SiO_2$) H2O | 8.50 |
| Alkyl ethoxy (3) sulfate | 3.00 |
| Termamyl 60T | 1.50 |
| Alcalase 2T | 3.60 |

TABLE 5-continued

| Ingredients | % by weight of active material |
|---|---|
| Sodium Percarbonate (Interox) (as AvO) | 1.50 |
| Benxoyl caprolactam | 3.80 |
| Diethylene triamine penta methylene phosphonic acid | 0.13 |
| Polydimethylsiloxane | 0.20 |
| Sulfate, water etc. | balance |
| pH | 8.5 |

[1]Dispersant from Rohm and Haas

EXAMPLE V

Granular automatic dishwashing detergents of the present invention are as follows:

TABLE 6

| Ingredients | % by weight of active material | |
|---|---|---|
| Sodium Citrate | 1.25 | 10.00 |
| Citric acid | 17.50 | 11.00 |
| Acusol 480N[1] | 6.00 | 6.00 |
| Sodium carbonate | 15.50 | 20.00 |
| Britesil (as $SiO_2$)H2O | 8.50 | 8.50 |
| Nonionic surfactant[2] | 2.00 | 3.00 |
| Termamyl 60T | 1.50 | 1.50 |
| Alcalase 2T | 3.60 | 3.60 |
| Sodium Perborate monohydrate (as AvO) | 1.50 | 1.50 |
| Sodium benzoyloxybenzene sulfonate | 3.80 | — |
| Benzoyl caprolactam | — | 3.80 |
| Diethylene triamine penta methylene phosphonic acid | 0.13 | 0.13 |
| Sulfate, water, etc. | balance | 10.10 |
| pH | 9.00 | 9.00 |

[1]Dispersant from Rohm and Haas.
[2]HLB nonionic surfactant

What is claimed is:

1. An automatic dishwashing detergent composition comprising:

a) from about 1% to about 50% by weight of a carbonate source selected from the group consisting of salts of carbonate, bicarbonate, sesquicarbonate, percarbonate, and mixtures thereof;

b) a calcium complexing component selected from the group consisting of citric acid, sodium citrate, and mixtures thereof, said calcium complexing component being present in a weight ratio to said carbonate source of at least 1.0, said composition having a pH from about 7 to about 12; and c) from about 0.5% to about 20% of a modified polyacrylate copolymer having a molecular weight of less than about 15,000 and which contains monomer units:

(i) from about 10% to 90%, by weight of said copolymer, of a monomer which is acrylic acid or its salt; and (ii) from about 10% to 90% by weight of a comonomer which is a substituted acrylic acid or salt of the formula

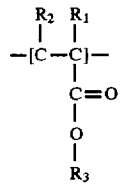

wherein $R_1$ and $R_2$ are each H, $C_{1-4}$ alkyl or hydroxyalkyl with at least one of $R_1$ and $R_2$ being $C_{1-4}$ alkyl or hydroxyalkyl and wherein $R_3$ is H, $C_{1-4}$ alkyl or hydroxyalkyl or alkali metal.

2. A composition according to claim 1 wherein said composition further comprises from about 1% to 99% by weight of a pH adjusting agent, selected from the group consisting of (i) sodium silicate;

(ii) sodium borate;

(iii) sodium hydroxide; and (iv) mixtures thereof;

said composition having a pH of from about 8 to 11.

3. A composition according to claim 2 further comprising from about 0.1% to about 10% of low foaming nonionic surfactant.

4. A composition according to claim 3 wherein said low foaming nonionic surfactant is alkoxylated alcohols.

5. A composition according to claim 4 further comprising from about 0.1% to about 8% of an anionic co-surfactant.

6. A composition according to claim 5 wherein said anionic cosurfactant is selected from the group consisting of alkylethoxysulfates, alklyethoxycarboxylates and mixtures thereof.

7. A composition according to claim 6 further comprising from about 0.001% to about 5% of a silicone suds suppressor.

8. A composition according to claim 7 further comprising from about 0.001% to about 5% of a detersive enzyme selected from the group consisting of protease, amylase, lipase and mixtures thereof.

9. A composition according to claim 8 comprising from about 0.005 to about 3% by weight protease or amylase.

10. A composition according to claim 9 further comprising from about 0.01% to about 6% by weight of an enzyme stabilizing system.

11. A composition according to claim 7 comprising 10% to about 35% of said carbonate source selected from the group consisting of carbonate, bicarbonate and mixtures thereof.

12. A composition according to claim 11 further comprising sufficient bleach to provide from about 0.1% to about 5.0% by weight available oxygen or chlorine.

13. A composition according to claim 2 comprising from about 2% to about 20% silicate having a $SiO_2$:$Na_2O$ ratio of 2:1.

14. A composition according to claim 1 wherein said carbonate source is percarbonate.

15. A composition according to claim 14 further comprising a bleach activator.

16. A composition according to claim 15 wherein said bleach activator is selected from the group consisting of tetraacetylethylene diamin), benzoylcaprolactam, 4-nitrobenzoylcaprolactam, 3-chlorobenzoylcaprolactam, benzoyloxybenzenesulfate, nonanoyloxybenzenesulphonate, perhydrolizable esters and mixtures thereof.

17. An automatic dishwashing detergent composition comprising:

a) from 10% to about 40% by weight of a carbonate source selected from the group consisting of carbonate, bicarbonate, sesquicarbonate, percarbonate, and mixtures thereof;

b) a calcium complexing component selected from the group consisting of sodium citrate, citric acid, and mixtures thereof, said calcium complexing agent being present in a weight ratio to said carbonate source of at least 1.0;

c) from 0 to about 10% of a low-foaming nonionic surfactant other than amine oxide;

d) from 0 to about 10% of an anionic cosurfactant;

e) from about 1% to about 25% $SiO_2$;

f) from 0 to about 10% of a silicone suds suppressor;

g) from 0 about 8% of an active detersive enzyme;

h) from 0.5 to about 20% of a dispersant modified polyacrylate copolymer having a molecular weight of less than about 15,000 and which contains monomer units:

(i) from about 10% to 90%, by weight of said copolymer, of a monomer which is acrylic acid or its salt; and (ii) from about 10% to 90% by weight of a comonomer which is a substituted acrylic acid or salt of the formula

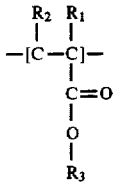

wherein $R_1$ and $R_2$ are each H, $C_{1-4}$ alkyl or hydroxyalkyl with at least one of $R_1$ and $R_2$ being $C_{1-4}$ alkyl or hydroxyalkyl and wherein $R_3$ is H, $C_{1-4}$ alkyl or hydroxyalkyl or alkali metal;

i) from 0 to about 5% of available chlorine or available oxygen bleach, said oxygen bleach selected from the group consisting of perborate, persulfate, and mixtures thereof; and j) from 0 to about 40% of sodium sulfate, wherein said composition has a pH of from about 7 to about 12.

18. A composition according to claim 17 having a pH of from about 8 to about 11.

19. A composition according to claim 18 comprising from about 10% to about 30% sodium citrate and from about 7% to about 25% sodium carbonate.

20. An method for cleaning soiled tableware comprising contacting said tableware in an automatic dishwashing machine with an aqueous medium having a pH in the range from about 7 to about 12 and comprising at least about 1% of a carbonate source selected from the group consisting of carbonate, sesquicarbonate, bicarbonate, percarbonate, and aqueous medium formed by dissolving a solid-form automatic dishwashing detergent containing said carbonate source and a calcium complexing component selected from the group consisting of sodium citrate, citric acid, and mixtures thereof, said calcium complexing component and said carbonate source having a weight:weight ratio of at least 1.0; and further comprising from 0.5% to about 20% of modified polyacrylate copolymer having a molecular weight of less than about 15,000 and which contains monomer units:

(i) from about 10% to 90%, by weight of said copolymer, of a monomer which is acrylic acid or its salt; and (ii) from about 10% to 90% by weight of a comonomer which is a substituted acrylic acid or salt of the formula

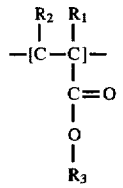

wherein $R_1$ and $R_2$ are each H, $C_{1-4}$ alkyl or hydroxyalkyl with at least one of $R_1$ and $R_2$ being $C_{1-4}$ alkyl or hydroxyalkyl and wherein $R_3$ is H, $C_{1-4}$ alkyl or hydroxyalkyl or alkali metal.

* * * * *